US005540066A

United States Patent [19]

Takimoto

[11] Patent Number: 5,540,066

[45] Date of Patent: Jul. 30, 1996

[54] BILATERAL-TYPE DOOR LOCKING HANDLE ASSEMBLY

[75] Inventor: Kazuhide Takimoto, Tokyo, Japan

[73] Assignee: Takigen Manufacturing Co. Ltd., Tokyo, Japan

[21] Appl. No.: 500,047

[22] Filed: Jul. 10, 1995

[30] Foreign Application Priority Data

Jul. 11, 1994 [JP] Japan ..... 6-297843

[51] Int. Cl.[6] ..... E05B 65/08

[52] U.S. Cl. ..... 70/99; 70/95; 292/210; 292/DIG. 46

[58] Field of Search ..... 70/95–100, 467, 70/468, 483–485, 489; 292/27, 29, 49, 52, 210, DIG. 46

[56] References Cited

U.S. PATENT DOCUMENTS

| | | | |
|---|---|---|---|
| 1,301,789 | 4/1919 | Howard et al. | 292/DIG. 46 X |
| 5,221,115 | 6/1993 | Takimoto | 292/DIG. 46 x |

FOREIGN PATENT DOCUMENTS

| | | | |
|---|---|---|---|
| 102273 | 1/1926 | Austria | 70/97 |
| 378436 | 7/1923 | Germany | 70/97 |
| 99476 | 6/1923 | Switzerland | 70/99 |
| 376475 | 7/1932 | United Kingdom | 292/29 |
| 850830 | 10/1960 | United Kingdom | 292/27 |

*Primary Examiner*—Lloyd A. Gall
*Attorney, Agent, or Firm*—Martin Smolowitz

[57] ABSTRACT

There is provided a bilateral-type door locking handle assembly. In the assembly in a leftward- and a rightward-retractable door unit enabling the assembly of a single type to be mass-produced and enabling reductions in manufacturing cost and a saving of storage space thereof: a left and a right latch plate 25 and 28 are rotatably mounted on fixed pivots 22 and 51, respectively; a lock disk 17 connected with a shaft 14 of a thumb turn 15 is provided with locking blades 18, 48; locking projections 30 and 31 abutting against the blades 18 and 48 are formed in upper shoulders of the latch plates 25 and 28, respectively; a shaft 33 for transmitting torque produced in handles 6, 9 is fitted in an interlocking shaft 35 in which a driving plate 40 is provided; and, a driving projection 39 abutting against a follower 37 of the latch plate 25 and 38 of the latch plate 28 is formed in an upper portion of the driving plate 40.

2 Claims, 5 Drawing Sheets

BILATERAL-TYPE DOOR LOCKING HANDLE ASSEMBLY

BACKGROUND OF THE INVENTION

1. Field of the Invention

The present invention relates to a bilateral-type door locking handle assembly employed in a doorway of a ship's cabin.

2. Description of the Prior Art

Conventional door units provided in cabin's doorways of yachts and the like comprise: hinged door units in each of which a door's rotation on a hinge pin opens the doorway; and, retractable or sliding door units in each of which a door's retracting or sliding movement linearly guided by a rail opens the doorway. The retracting or sliding door units further comprise: ones in each of which a door is moved to the left to open the doorway (hereinafter referred to as the leftward-retractable door units); and, the other ones in each of which a door is moved to the right to open the doorway (hereinafter referred to as the rightward-retractable door units).

As for a conventional door locking handle assembly, it is possible for a user to mount the handle assembly in only a predetermined one of a left side and a right side of a door. In other words, it is not possible for the user to replace the handle assembly (which is designed for use in the leftward-retractable door unit) with that designed for use in the rightward-retractable door unit or vice versa. Consequently, it is required for the manufacturers to produce two different types of the handle assembly and stock them separately, which requires a large stock space and makes it difficult to save manufacturing costs.

Further, in the conventional door locking handle assembly, since its operating handle is restricted in rotation by a simple lock mechanism which is poor in key variations, there is a fear that the door locking handle assembly is illegally unlocked through lock picking and like criminal actions.

SUMMARY OF THE INVENTION

It is an object of the present invention to provide a bilateral-type door locking handle assembly which is employed in both the leftward-retractable and the rightward-retractable door units, which makes it possible to produce only one type of the handle assembly through mass production to save manufacturing costs and a stock space of the product, and restricts an operating handle in rotation by a lock mechanism which has wide variations of key to prevent the handle assembly from being illegally unlocked.

The above objects of the present invention are accomplished by providing:

a bilateral-type door locking handle assembly comprising:

a front casing fixedly mounted on a front side of a door;

a rear casing fixedly mounted on a rear side of the door;

a front handle having its base shaft portion rotatably mounted in a bearing portion of the front casing;

a rear handle having its base shaft portion rotatably mounted in a bearing portion of the rear casing;

a base plate which is received in the rear casing, fixedly mounted on the door, and provided with a bearing portion;

a thumb turn having its base-end shaft portion mounted rotatably in a bearing portion of the rear casing;

a lock disk, which is connected with the base-end shaft portion of the thumb turn so as to be rotatably driven together with the thumb turn, is disposed between the rear casing and the base plate, provided with a pair of diametrically opposed locking blades in its outer surface, and provided with a lock hole;

an operating plate which is rotatably mounted in the bearing portion of the base plate and received in the lock hole of the lock disk in an insertion manner so as to engage with the lock disk;

a first spring disposed between the rear casing and a rectangular trunk surface of the lock disk so as to hold the thumb turn in its locking and its unlocking position;

a left-side latch plate which has its intermediate portion rotatably mounted on a fixed pivot of the rear casing, its upper-end hook portion projected from a left-side opening of the rear casing, arid has a locking projection formed in its upper-end shoulder portion, the locking projection abutting against a left one of the locking blades;

a right-side latch plate which has its intermediate portion rotatably mounted on a fixed pivot of the rear casing, its upper-end hook portion projected from a right-side opening of the rear casing, and a locking projection formed in its upper-end shoulder portion, the locking projection abutting against a right one of the locking-blades;

a second spring disposed between the rear casing and the left-side latch plate so as to bias the left-side latch plate into its locking position;

a third spring disposed between the rear casing and the right-side latch plate so as to bias the right-side latch plate into its locking position;

an interlocking shaft which is rotatably mounted between the rear casing and the base plate, and provided with an axial hole in which an axial shaft of the rear handle is inserted, the axial shaft being inserted also into an axial hole of the front handle;

a driving plate which is provided in the interlocking shaft, and provided with a driving projection formed integrally with its upper-end portion, the driving projection abutting against each of a follower arm portion of the left-side latch plate and a follower arm, portion of the right-side latch plate;

a lock unit which is fixedly mounted on the front casing and provided with a rotor connected with the operating plate;

a key which is inserted into a key hole of the lock unit to rotate the rotor to its locking and its unlocking position;

a socket piece provided in a left-side post wall of a doorway so as to be engaged with and disengaged from the front-end hook portion of the left-side latch plate; and a socket piece provided in a right-side post wall of the doorway so as to be engaged with and disengaged from the front-end hook portion of the right-side latch plate.

DESCRIPTION OF THE PREFERRED EMBODIMENTS

Figure 1:
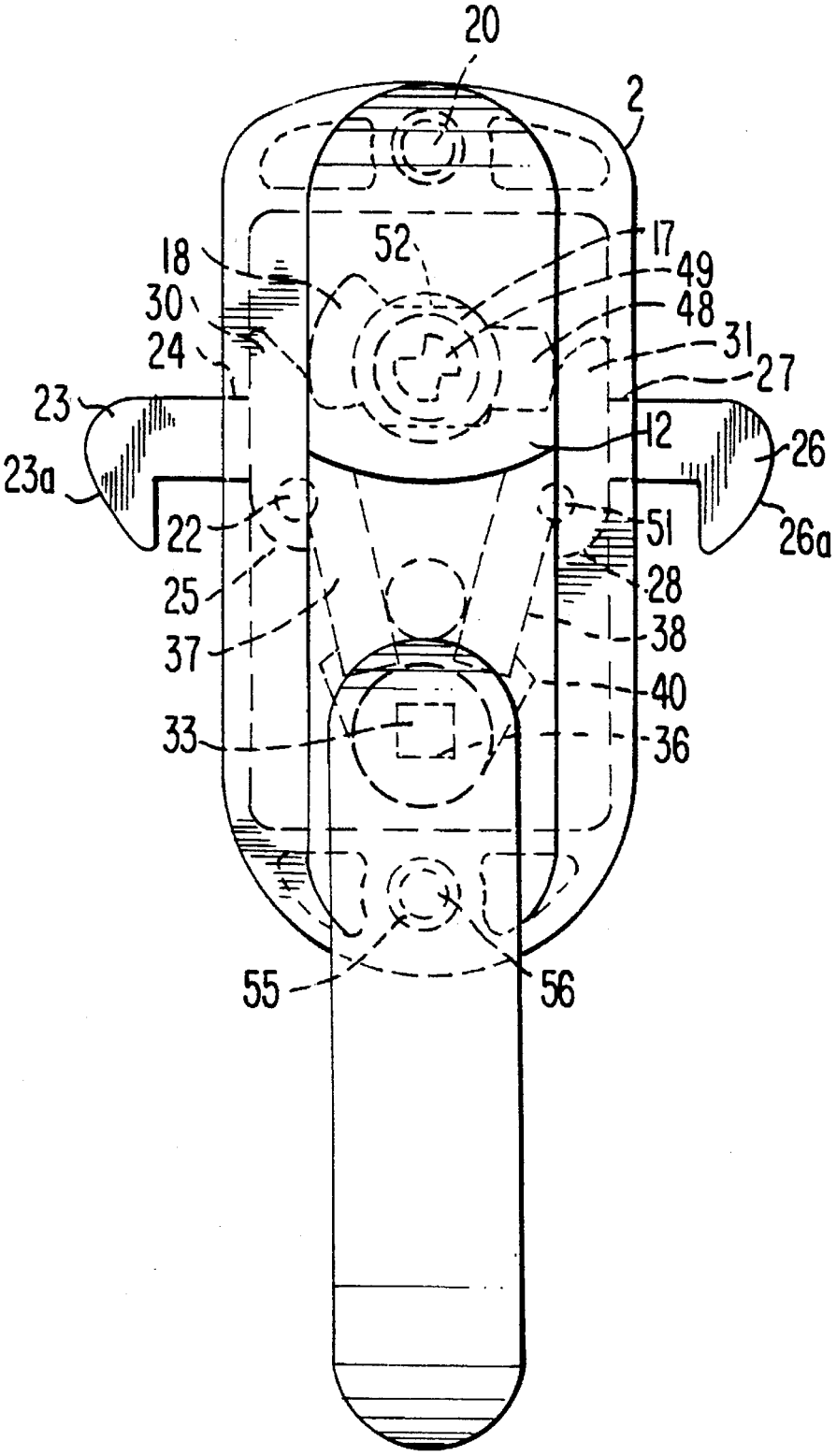
FIG. 1 is a front view of an embodiment of the door locking handle assembly of the present invention.
Figure 2:
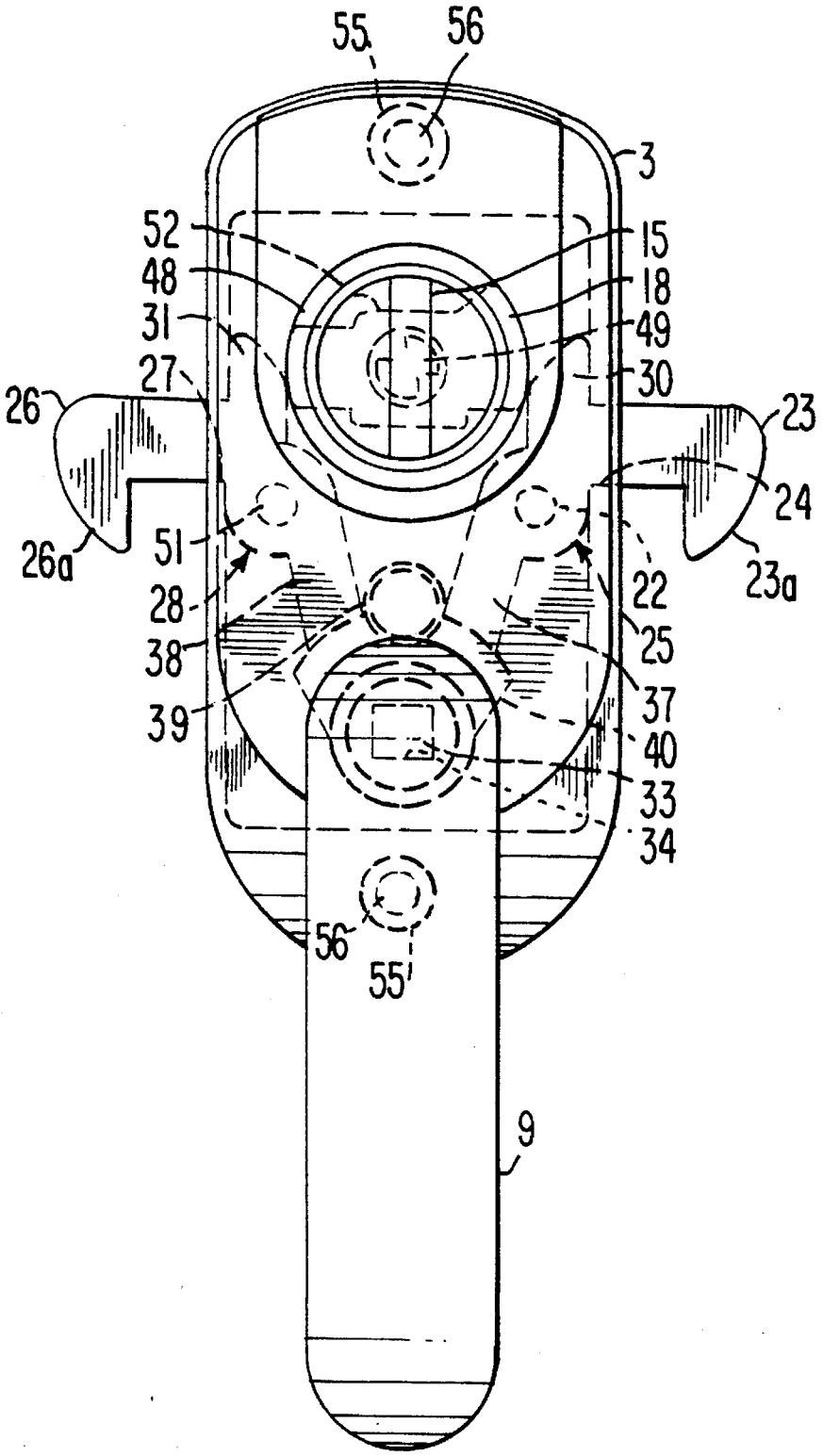
FIG. 2 is a rear view of the door locking assembly of the present invention shown in FIG. 1.
Figure 3:
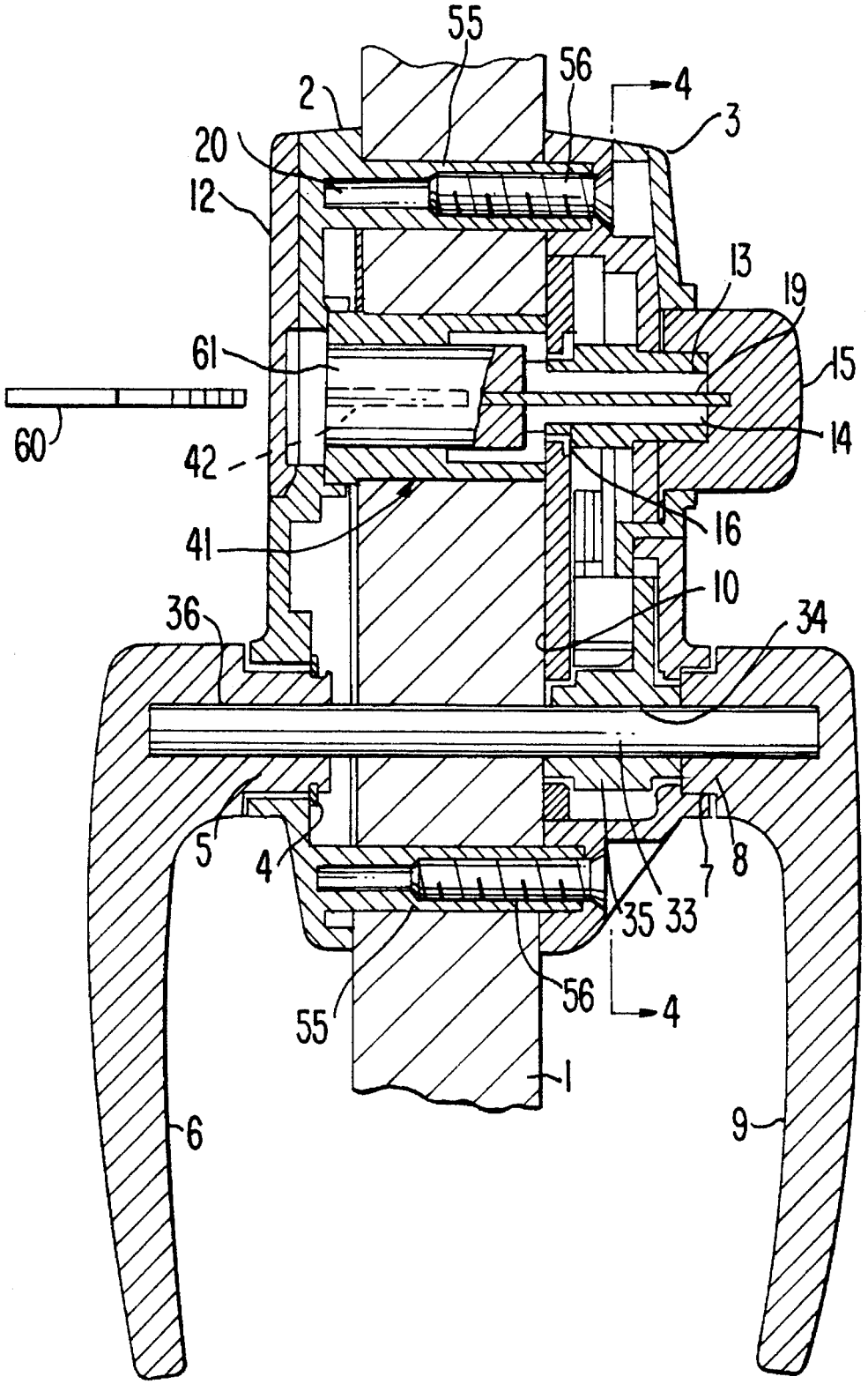
FIG. 3 is a longitudinal sectional view of the door locking assembly of the present invention shown in FIG. 1, taken along a vertical center line of the assembly.

Hereinbelow, the present invention will be described in detail with reference to the accompanying drawings and the reference numerals and characters therein.

A bilateral type door locking handle assembly of the present invention comprises: a front casing 2 fixedly mounted on a front side of a door 1; a rear casing 3 fixedly mounted on a rear side of the door 1; a front handle 6 having its base shaft portion 5 rotatably mounted in a bearing portion 4 of the front casing 2; a rear handle 9 having its base shaft portion 8 rotatably mounted in a bearing portion 7 of the rear casing 3; a base plate 10 which is received in the rear casing 3 and fixedly mounted on the door 1; and, a thumb turn 15 having its base-end shaft portion 14 mounted rotatably in a bearing portion 13 of the rear casing 3.

The door locking handle assembly of the present invention further comprises: a lock disk 17, which is connected with the base-end shaft portion 14 of the thumb turn 15 so as to be rotatably driven together with the thumb turn 15, is disposed between the rear casing 3 and the base plate 10, provided with a pair of diametrically opposed locking blades 18, 48 in its outer surface, and provided with a lock hole 49; an operating plate 19 which is rotatably mounted in the bearing portion 16 of the base plate 10 and received in the lock hole 49 of the lock disk 17 in an insertion manner so as to engage with the lock disk 17; and, a first spring 21 disposed between the rear casing 3 and a rectangular trunk surface 52 of the lock disk 17 so as to hold the thumb turn 15 in its locking and its unlocking position.

Further, the door locking handle assembly of the present invention comprises: a left-side latch plate 25 which has its intermediate portion rotatably mounted on a fixed pivot 22 of the rear casing 3, its upper-end hook portion 23 projected from a left-side opening 24 of the rear casing 3, and has a locking projection 30 formed in its upper-end shoulder portion, the locking projection 30 abutting against a left one blade 18 of the locking blades 18, 48; a right-side latch plate 28 which has its intermediate portion rotatably mounted on a fixed pivot 51 of the rear casing 3, its upper-end hook portion 26 projected from a right-side opening 27 of the rear casing 3, and a locking projection 31 formed in its upper-end shoulder portion, the locking projection 31 abutting against a right one blade 48 of the locking blades 18, 48; a second spring 32 disposed between the rear casing 3 and the left-side latch plate 25 so as to bias the left-side latch plate 25 into its locking position; a third spring 50 disposed between the rear casing 3 and the right-side latch plate 28 so as to bias the right-side latch plate 28 into its locking position; an interlocking shaft 35 which is rotatably mounted between the rear casing 3 and the base plate 10, and provided with an axial hole 34 in which an axial shaft 33 of the rear handle 9 is inserted, the axial shaft 33 being inserted also into an axial hole 36 of the front handle 6; and, a driving plate 40 which is provided in the interlocking shaft 35, and provided with a driving projection 39 formed integrally with its upper-end portion, the driving projection 39 abutting against each of a follower arm portion 37 of the left-side latch plate 25 and a follower arm portion 38 of the right-side latch plate 28.

Still further, the door locking handle assembly of the present invention comprises: a lock unit 41 which is fixedly mounted on the front casing 2 and provided with a rotor 61 connected with the operating plate 19; a key 60 which is inserted into a key hole 42 of the lock unit 41 to rotate the rotor 61 to its locking and its unlocking position; a socket piece 45 provided in a left-side post wall 44 of a doorway 43 so as to be engaged with and disengaged from the front-end hook portion 23 of the left-side latch plate 25; and, a socket piece 47 provided in a right-side post wall 46 of the doorway 43 so as to be engaged with and disengaged from the front-end hook portion 26 of the right-side latch plate 28.

Figure 4:
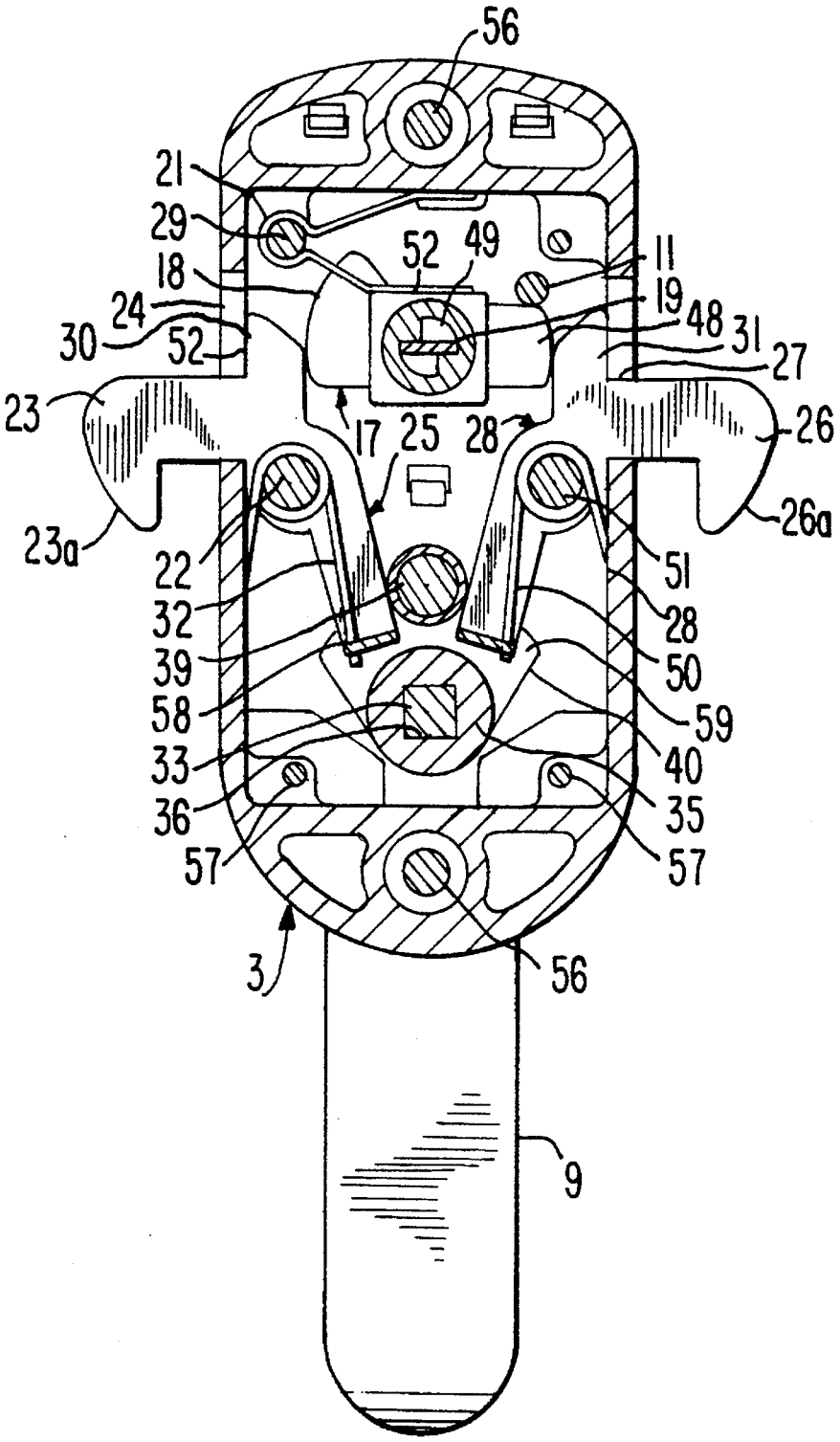
FIG. 4 is a longitudinal sectional view of the door locking assembly of the present invention, taken along the line 4—4 of FIG. 3.
Figure 5:
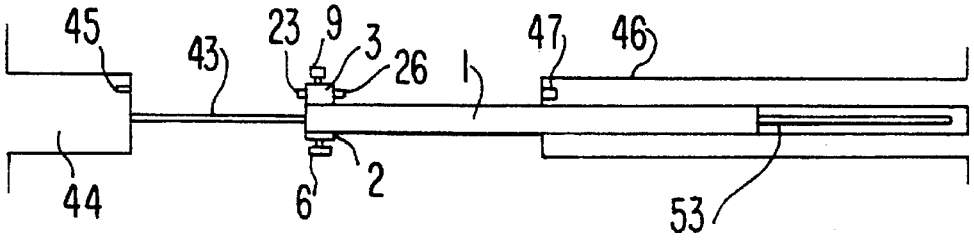
FIG. 5 is a schematic plan view of the door locking assembly of the present invention used in the rightward-retractative door unit.

In operation, first, as shown in FIG. 5, in the rightward-retractable door unit, when a user moves the door 1 to the left by using the front handle 6 or the rear handle 9 so that the doorway 43 is closed, a circularly-curved cam surface 23*a* (shown in FIG. 1) of the upper-end hook portion 23 of the left-side latch plate 25 is brought into a slidable contact with an edge portion of an opening of the socket piece 45 at the end of the closing operation of the door 1, so that the left-side latch plate 25 is rotated temporarily clockwise as is clear from FIG. 4. When the door 1 abuts against the left-side post wall 44 to reach its closed position so that the upper-end hook portion 23 of the left-side latch plate 25 passes through the edge portion of the opening of the socket piece 45, the left-side latch plate 25 is then rotated counterclockwise under the influence of a resilient force exerted by the second spring 32, so that the upper-end hook portion 23 of the latch plate 25 is fully engaged with the socket piece 45. Since the second spring 32 keeps the upper-end hook portion 23 of the latch plate 25 engaged with the socket piece 45 under the influence of its resilient force as described above, the door 1 is forcibly held in its closed position.

In case that the user locks the door 1 in a front side thereof, the key 60 is inserted into the key hole 42 of the lock unit 41 mounted on the front casing 2, so that the operating plate 19 connected with the rotor 61 is rotated counterclockwise to push an inner wall of the lock hole 49, whereby the lock disk 17 is rotated to reach its horizontal position, as shown in FIG. 4. At this time, the left-side locking blade 18 of the lock disk 17 abuts against the locking projection 30 of the left-side latch plate 25.

On the other hand, when the user locks the door 1 in the rear side thereof, the user rotates the thumb turn 15 so that the lock disk 17 is rotated by the operating plate 19 in the same direction as that of the base-end shaft portion 14 of the thumb turn 15, which portion 14 is connected with the operating plate 19. As a result, the locking blade 18 of the lock disk 17 abuts against the locking projection 30 of the latch plate 25 to prevent the latch plate 25 from performing its clockwise turn, which makes it impossible to turn the front handle 6 or the rear handle 9. Consequently, the door 1 is held in its locked position.

In case the user opens the door 1 at its front side in a condition in which the door 1 is locked by the locking blade 18 of the lock disk 17, he or she unlocks the door locking handle assembly, and then grips the front handle 6. In case that the door locking assembly is not, unlocked, the user immediately grips the front handle 6. After that, the interlocking shaft 35 is rotated counterclockwise as viewed in FIG. 4. In this rotating operation, the driving projection 39 of the driving plate 40 pushes the follower arm portion 37 of the left-side latch plate 25, so that the latch plate 25 rotates clockwise to have its upper-end hook portion 23 disengaged from the socket piece 45. After that, when the front handle 6 is pulled to the right as viewed in FIG. 5, the door 1 is separated from the left-side post, wall 44 and then retracted or received in a door storage space 53 of the right-side post wall 46 so that the doorway 43 is opened.

In case the door 1 is opened at its rear side as viewed in FIG. 5 in a condition in which the door locking handle assembly is locked by means of the thumb turn 15, the user unlocks the thumb turn 15 and then grips the rear handle 9. When the thumb turn 15 is not locked, he or she immediately grips the rear handle 9 so that the interlocking shaft 35 is rotated counterclockwise as viewed in FIG. 4. In this rotating operation, the driving projection 39 of the driving plate 40 pushes the follower arm portion 37 of the left-side latch plate 25 so that the latch plate 25 rotates clockwise to have its upper-end hook portion 23 disengaged from the socket piece 45. After that, when the rear handle 9 is pulled to the right as viewed in FIG. 5, the door 1 is separated from the left-side post wall 44 and then retracted or received in the door storage space 53 of the right-side post wall 46 so that the doorway 43 is opened.

In the end of any one of the above-described door's opening operations performed in opposite sides of the door 1, the circularly-curved cam surface 26a of the upper-end hook portion 26 of the right-side latch plate 28 is brought into a slidable contact with the edge portion of the opening of the socket piece 47 to have the latch plate 28 rotated temporarily counterclockwise as viewed in FIG. 4. When the door 1 reaches its closed position so that the front-end hook portion 26 of the latch plate 28 passes through the edge portion of the opening of the socket piece 47, the right-side latch plate 28 is then rotated clockwise under the influence of the resilient force exerted by the third spring 50 to have its upper-end hook portion 26 of the latch plate 28 engaged with the socket piece 47. Since the third spring 50 biases the upper-end hook portion 26 of the latch plate 28 into the socket piece 47 to hold the upper-end hook portion 26 therein, the door 1 is held in its opened position.

In case that the door 1 is locked in its front side, the key 60 is inserted into the key hole 42 of the lock unit 41 so that the lock disk 17 is rotated through the operating plate 19 to reach its horizontal position, as shown in FIG. 4. In this rotating operation, the right-side locking blade 48 of the lock disk 17 abuts against the locking projection 31 of the right-side latch plate 28.

On the other hand, in case that the door 1 is locked in its rear side, first of all, the thumb turn 15 is rotated so that the lock disk 17 is rotated by the operating plate 19 in the same direction as that of the thumb turn 15 through the base-end shaft portion 14 of the thumb turn 15, which portion 14 is interlocked with the operating plate 19, whereby the locking blade 48 of the lock disk 17 abuts against the locking projection 31 of the right-side latch plate 28 to prevent the latch plate 28 from rotating counterclockwise. As a result, it is not possible to rotate both the front handle 6 and the rear handle 9, and, therefore not possible to close the door 1, whereby the door 1 is locked in its opened position.

Figure 6:
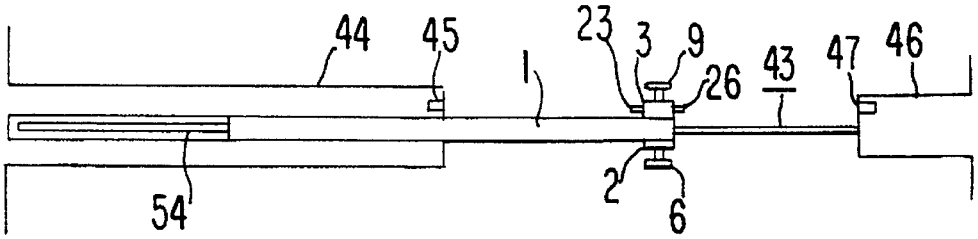
FIG. 6 is a schematic plan view of the door locking assembly of the present invention used in the leftward-retractable door unit.

In the door locking handle assembly retractable door unit as shown in FIG. 6, the upper-end hook portion 26 of the right-side latch plate 28 engages with the socket piece 47 of the right-side post wall 46 at the end of closing operation of the door 1. On the other hand, the upper-end hook portion 23 of the left-side latch plate 25 engages with the socket piece 45 of the left-side post wall 44 at the end of opening operation of the door 1 so that the door 1 is received in a door storage space 54 of the left-side post wall 44. Opening/closing and locking/unlocking operations of the door 1 of the leftward-retractable door unit shown in FIG. 6 are the substantially same in manner as those of the rightward-retractable door unit shown in FIG. 5.

Namely, in case that the user opens the door 1 in its front side in a condition in which the door 1 is locked by the locking blade 48 of the lock disk 17, he or she unlocks the door locking handle assembly, and then grips the front handle 6. In case that the door locking assembly is unlocked, the user immediately grips the front handle 6. After that, the interlocking shaft 35 is rotated clockwise as viewed in FIG. 4. In this rotating operation, the driving projection 39 of the driving plate 40 pushes the follower arm portion 38 of the right-side latch plate 28 so that the latch plate 28 rotates counterclockwise to have its upper-end hook portion 26 disengaged from the socket piece 47. After that, when the front handle 6 is pulled to the left as viewed in FIG. 6, the door 1 is separated from the right-side post wall 46 and then retracted or received in a door storage space 54 of the left-side pose wall 44 so that the doorway 43 is opened.

In case that the door 1 is opened in its rear side as viewed in FIG. 6 in a condition in which the door locking handle assembly is locked by means of the thumb turn 15, the user unlocks the thumb turn 15 and then grips the rear handle 9. When the thumb turn 15 is not locked, he or she immediately grips the rear handle 9 so that the interlocking shaft 35 is rotated clockwise as viewed in FIG. 4. In this rotating operation, the driving projection 39 of the driving plate 40 pushes the follower arm portion 38 of the right-side latch plate 28 so that the latch plate 28 rotates counterclockwise to have its upper-end hook portion 26 disengaged from the socket piece 47. After that, when the rear handle 9 is pulled to the left as viewed in FIG. 6, the door 1 is separated from the right-side post wall 46 and then retracted or received in the door storage space 54 of the left-side post wall 44 so that the doorway 43 is opened.

In the embodiment of the present invention shown in the drawings, both the front casing 2 and the rear casing 3 are fixedly mounted on the door 1 by means of screws 56 each of which is inserted into the door 1 from the rear side thereof and threadably engaged with a threaded hole of each of cylindrical boss portions 55 of the front casing 2. The base plate 10 is embedded in a front-end portion of the rear casing 3, and fixedly mounted therein by means of screws 57 each of which is threadably engaged with a threaded hole of each of cylindrical boss portions of the rear casing 3. The first spring or return spring 21 of the lock disk 17 is constructed of a coil spring mounted on one portion 29 of the cylindrical boss portions of the rear casing 3. The locking hole 49 of the lock disk 17 assumes shape comprising a pair of sector holes in which the operating plate 19 assuming a flat shape is inserted.

The rear casing 3 is provided with a stop projection 11 for preventing the locking blade 48 from passing through its locked position. The other springs or return springs 32 and 50, each of which is constructed of a coil spring, are mounted on the fixed pivots 22 and 51, respectively. The spring support projections 58 and 59 of these springs 32, 50 are formed in lower-end portions of the left-side latch plate 25 and the right-side latch plate 28, respectively. The axial shaft 33, which assumes a square shape in cross-section, is integrally formed with the rear handle 9 and received in both of a corresponding square axial hole 34 of a central portion of the interlocking shaft 35 and a corresponding square axial hole 36 of the front handle 6. Pivotally mounted on the front casing 2 through a pivot 20 is a cap 12 for closing the key hole 42 of the lock unit 41.

In the door locking handle assembly of the present invention having the above construction: the left-side latch plate 25 and the right-side latch plate 28 are rotatably mounted on the fixed pivots 22 and 51, respectively; the lock disk 17, which is connected with the base-end shaft portion 14 of the thumb turn 15, is provided with the locking blades 18, 48; the locking projection 30 abutting against the locking blade 18 is provided in an upper-end shoulder portion of the left-side latch plate 25; the locking projection 31 abutting against the locking blade 48 is provided in the upper-end shoulder portion of the right-side latch plate 28; the axial shaft 33, to which torque is transmitted from the front handle 6 and the rear handle 9, is received in the interlocking shaft 35; the interlocking shaft 35 is provided with the driving plate 40; and, the driving plate 40 is provided with the driving projection 39 in its upper-end portion to have the driving projection 39 abut against both the follower arm portion 37 of the left-side latch plate 25 and the follower arm portion 38 of the right-side latch plate 28. Consequently, the door locking handle assembly of the present invention does not require any conversion in assembling works nor require any additional parts in its production when it is used in any one of the leftward-retractable and the rightward-retractable door units, which makes it possible to manufacture a single type product through mass production, and, therefore to save both the manufacturing costs and the storage space of the product.

Further, in the door locking handle assembly of the present invention, since it is possible for the user to control the rotational movement of the lock disk 17 by the use of the operating plate 19 only, there is no fear that the handle assembly of the present invention malfunctions. Such simple construction of the handle assembly of the present invention enables its manufacturers to easily produce the handle assembly, and, therefore to save the manufacturing costs thereof.

What is claimed is:

1. A bilateral-type door locking handle assembly comprising:

a front casing (2) fixedly mounted on a front side of a door (1);

a rear casing (3) fixedly mounted on a rear side of said door (1);

a front handle (6) having its base shaft portion (5) rotatably mounted in a bearing portion (4) of said front casing (2);

a rear handle (9) having its base shaft portion (8) rotatably mounted in a bearing portion (7) of said rear casing (3);

a base plate (10) which is received in said rear casing (3), fixedly mounted on said door (1), and provided with a bearing portion (16);

a thumb turn (15) having its base-end shaft portion (14) mounted rotatably in a bearing portion (13) of said rear casing (3);

a lock disk (17), Which is connected with said base-end shaft portion (14) of said thumb turn (15) so as to be rotatably driven together with said thumb turn (15), is disposed between said rear casing (3) and said base plate (10), provided with a pair of diametrically opposed locking blades (18, 48) in its outer surface, and provided with a lock hole (49);

an operating plate (19) which is rotatably mounted in said bearing portion (16) of said base plate (10) and received in said lock hole (49) of said lock disk (17) in an insertion manner so as to engage with said lock disk (17);

a first spring (21) disposed between said rear casing (3) and a rectangular trunk surface (52) of said lock disk (17) so as to hold said thumb turn (15) in its locking and unlocking position;

a left-side latch plate (25) which has its intermediate portion rotatably mounted on a fixed pivot (22) of said rear casing (3), its upper-end hook portion (23) projected from a left-side opening (24) of said rear casing (3), and has a locking projection (30) formed in its upper-end shoulder portion, said locking projecting (30) abutting against a left one blade (18) of said locking blades (18, 48);

a right-side latch plate (28) which has its intermediate portion rotatably mounted on a fixed pivot (51) of said rear casing (3), its upper-end hook portion (26) projected from a right-side opening (27) of said rear casing (3), and a locking projection (31) formed in its upper-end shoulder portion, said locking projection (31) abutting against a right one blade (48) of said locking blades (18, 48);

a second spring (32) disposed between said rear casing (3) and said left-side latch plate (25) so as to bias said left-side latch plate (25) into its locking position;

a third spring (50) disposed between said rear casing (3) and said right-side latch plate (28) so as to bias said right-side latch plate (28) into its locking position;

an interlocking shaft (35) which is rotatably mounted between said rear casing (3) and said base plate (10), and provided with an axial hole (34) in which an axial shaft (33) of said rear handle (9) is inserted, said axial shaft (33) being inserted also into an axial hole (36) of said front handle (6);

a driving plate (40) which is provided in said interlocking shaft (35), and provided with a driving projection (39) formed integrally with its upper-end portion, said driving projection (39) abutting against each of a follower arm portion (37) of said left-side latch plate (25) and a follower arm portion (38) of said right-side latch plate (28);

a lock unit (41) which is fixedly mounted on said front casing (2) and provided with a rotor (61) connected with said operating plate (19);

a key (60) which is inserted into a key hole (42) of said lock unit (41) to rotate said rotor (61) to its locking and its unlocking position;

a socket piece (45) provided in a left-side post wall (44) of a doorway (43) so as to be engaged with and disengaged from said upper-end hook portion (23) of said left-side latch plate (25); and a socket piece (47) provided in a right-side post wall (46) of said doorway (43) so as to be engaged with and disengaged from said upper-end hook portion (26) of said right-side latch plate (28).

2. The door locking handle assembly of claim 1, wherein both said front casing (2) and said rear casing (3) are fixedly mounted on said door (1) by means of threaded screws (56) inserted into a cylindrical boss portion (55) of said front casing (2).

* * * * *